US007164075B2

(12) United States Patent
Tada

(10) Patent No.: US 7,164,075 B2
(45) Date of Patent: Jan. 16, 2007

(54) MUSIC SESSION SUPPORT METHOD, MUSICAL INSTRUMENT FOR MUSIC SESSION, AND MUSIC SESSION SUPPORT PROGRAM

(75) Inventor: Yukio Tada, Shizuoka-ken (JP)

(73) Assignee: Yamaha Corporation, Shizuoka-ken (JP)

( * ) Notice: Subject to any disclaimer, the term of this patent is extended or adjusted under 35 U.S.C. 154(b) by 217 days.

(21) Appl. No.: 11/002,427

(22) Filed: Dec. 2, 2004

(65) Prior Publication Data

US 2005/0120865 A1 Jun. 9, 2005

(30) Foreign Application Priority Data

Dec. 4, 2003 (JP) ..... 2003-405494

(51) Int. Cl.
*G10H 1/36* (2006.01)
*G10H 7/00* (2006.01)

(52) U.S. Cl. ..... 84/610; 84/609; 84/634; 84/645; 84/649; 84/650

(58) Field of Classification Search ..... None
See application file for complete search history.

(56) References Cited

U.S. PATENT DOCUMENTS 6,074,215 A * 6/2000 Tsurumi ..... 434/307 A
6,598,074 B1 7/2003 Moller
6,936,758 B1 * 8/2005 Itoh ..... 84/470 R
7,074,999 B1 * 7/2006 Sitrick et al. ..... 84/477 R
2001/0007960 A1 7/2001 Yoshihara et al.
2002/0144586 A1 * 10/2002 Connick ..... 84/478
2003/0110926 A1 * 6/2003 Strick et al. ..... 84/477 R
2003/0167904 A1 * 9/2003 Itoh ..... 84/609

FOREIGN PATENT DOCUMENTS

EP 0933906 8/1999
EP 1202490 5/2002

* cited by examiner

*Primary Examiner*—Marlon Fletcher
(74) *Attorney, Agent, or Firm*—Harness, Dickey & Pierce, P.L.C.

(57) ABSTRACT

A music session support method which enables each of players in a music session which is performed via a network to immediately recognize whether or not the other players are in the state of being able to participate in the session. A session support apparatus 10 transmits sets of status information indicative of whether or not each of players is in a state of being able to participate in a session, and player identification information which identifies the players, to each of session terminals 20. Each of the session terminals 20 which have received the sets of status information and player identification information causes a touch display 24 thereof to display the status information for each of the players. The session support apparatus 10 acquires a set of status transition information indicating that a player of at least one of the session terminals 20 in which the detecting device has detected the performance preparatory operation has gone into the state of being able to participate in a session, and player identification information for a session terminal 20, from the session terminal 20. The session support apparatus 10 transmits the acquired set of status transition information and player identification information to the session terminals 20. Each of the session terminals 20 updates contents displayed on the touch display 24 thereof, based upon the status transition information and player identification information transmitted from the session support apparatus 10.

6 Claims, 14 Drawing Sheets

FIG. 4

| NICKNAME | ID |
|---|---|
| PROF. SAEZAKI | sae1970 |
| MR. ENDO | endo |
| MR. NOMURA | 7nomura |
| GRANNY | yone |

MUSIC SESSION SUPPORT METHOD, MUSICAL INSTRUMENT FOR MUSIC SESSION, AND MUSIC SESSION SUPPORT PROGRAM

BACKGROUND OF THE INVENTION

1. Field of the Invention

The present invention relates to a music session support method, a musical instrument for music sessions, and a music session support program.

2. Description of the Related Art

Attempts have been made to implement a music session by a set of players who are remote to one another by connecting together a plurality of computers, to which musical instruments are connected, via a network, and exchanging music data between these computers. Techniques have even been proposed for supporting the implementation of this type of music session.

For example, a system has been proposed which implements mutual collaboration upon composition of music data by a plurality of users who are remote from one another (for example, refer to Japanese Laid-Open Patent Publication (Kokai) No. 2001-195064). This system is comprised of client apparatuses of the users and a server apparatus which manages and controls the composition work performed by the various users in collaboration. This server apparatus is provided with a chat function, so that, when inputting or editing of music composition data is performed upon any one of the client apparatuses, the details thereof are distributed directly to the other client apparatuses via the server apparatus.

However, when players who are remote from one another participate in a music session via a server apparatus in this manner, each of the players cannot be clearly aware of whether the other players who are his partners in the session are currently in the state of immediately participating in the session, or whether they are not currently in the state of being able to participate in the session although they are connected to the server apparatus.

SUMMARY OF THE INVENTION

It is the object of the present invention to provide a music session support method, a musical instrument for music sessions, and a music session support program which enable each of players in a music session which is performed via a network to immediately recognize whether or not the other players are in the state of being able to participate in the session.

To attain the above object, in a first aspect of the present invention, there is provided a music session support method executed by a music session system comprising a plurality of session terminals, each having a detecting device that detects a performance preparatory operation by a player, and a session support apparatus which is connected to the plurality of session terminals, for acting as a go-between for transmission and reception of music data between the plurality of session terminals, comprising a status information transmitting step in which the session support apparatus transmits sets of status information indicative of whether or not each of players is in a state of being able to participate in a session, and player identification information which identifies the players, to the session terminals, a status information display step in which each of the session terminals which have received the sets of status information and player identification information causes the display device thereof to display the status information for each of the players, a status transition information acquiring step in which the session support apparatus acquires a set of status transition information indicating that a player of at least one of the session terminals in which the detecting device has detected the performance preparatory operation has gone into the state of being able to participate in a session, and player identification information for the session terminal, from the session terminal, a status transition information transmitting step in which the session support apparatus transmits the acquired set of status transition information and player identification information to the session terminals, and a status information updating step in which each of the session terminals updates contents displayed on the display device thereof, based upon the status transition information and player identification information transmitted from the session support apparatus.

To attain the above object, in a second aspect of the present invention, there is provided a music session support method executed by a music session system comprising a plurality of session terminals, each having a detecting device that detects a performance preparatory operation by a player, and a session support apparatus which is connected to the plurality of session terminals, for acting as a go-between for transmission and reception of music data between the plurality of session terminals, comprising a status information transmitting step in which the session support apparatus transmits sets of status information indicative of whether or not each of players is in a state of being able to participate in a session, and player identification information which identifies the players, to the session terminals, a status information display step in which each of the session terminals which have received the sets of status information and player identification information causes the display device thereof to display the status information for each of the players, a status transition information acquiring step in which the session support apparatus acquires a set of status transition information indicating that a player of a first one of the session terminals in which the detecting device has detected start of a performance by the player has gone into the state of being able to participate in a session, and player identification information for the first session terminal, from the first session terminal, and the session support apparatus acquires a set of status transition information indicating that a player of a second one of the session terminals in which the detecting device has detected stoppage of a performance by the player over a predetermined time period has gone into a state of being unable to participate in a session, and player identification information for the second session terminal, from the second session terminal, a status transition information transmitting step in which the session support apparatus transmits the acquired set of status transition information and player identification information to the session terminals, and a status information updating step in which each of the session terminals updates contents displayed on the display device thereof, based upon the status transition information and player identification information transmitted from the session support apparatus.

To attain the above object, in a third aspect of the present invention, there is provided a musical instrument for music sessions, which implements a music session by performing transmission and reception of music data to and from one or a plurality of players, comprising a display device that displays status information indicative of whether or not players are in a state of being able to participate in a session, and player identification information for the players, in association with one another, a detecting device that detects a performance preparatory operation by a player, a transmission device operable when the performance preparatory operation has been detected by the detecting device, to transmit a set of status transition information indicating that the player has gone into the state of being able to participate in a session, and player identification information identifying the player, a receiving device that receives sets of status transition information indicating that at least one of the one or plurality of players has gone into the state of being able to participate in a session and player identification information identifying the at least one player, and an updating device operable when the set of status transition information and player identification information has been received by the receiving device, to update contents of the status information which is displayed on the display device in association with the received player identification information.

To attain the above object, in a fourth aspect of the present invention, there is provided a musical instrument for music sessions, which implements a music session by performing transmission and reception of music data to and from one or a plurality of players, comprising a display device that displays status information indicative of whether or not players are in a state of being able to participate in a session, and player identification information for the players, in association with one another, a detecting device that detects a performance preparatory operation by a player, a transmission device operable when the performance preparatory operation has been detected by the detecting device, to transmit a set of status transition information indicating that the player has gone into the state of being able to participate in a session, and player identification information identifying the player, the transmission device being operable when the detecting device has detected stoppage of a performance by the player over a predetermined time period, to transmit a set of status transition information indicating that the player has gone into a state of being unable to participate in a session, and player identification information identifying the player, a receiving device that receives sets of status transition information indicating that at least one of the one or plurality of players has gone into the state of being able to participate in a session or the state of being unable to participate in a session and player identification information identifying the at least one player, and-an updating device operable when the set of status transition information and player identification information has been received by the receiving device, to update contents of the status information which is displayed on the display device in association with the received player identification information.

To attain the above object, in a fifth aspect of the present invention, there is provided a program for causing a computer to implement a music session support method executed by a music session system comprising a plurality of session terminals, each having a detecting device that detects a performance preparatory operation by a player, and a session support apparatus which is connected to the plurality of session terminals, for acting as a go-between for transmission and reception of music data between the plurality of session terminals, comprising a status information transmitting module in which the session support apparatus transmits sets of status information indicative of whether or not each of players is in a state of being able to participate in a session, and player identification information which identifies the players, to the session terminals, a status information display module in which each of the session terminals which have received the sets of status information and player identification information causes the display device thereof to display the status information for each of the players, a status transition information acquiring module in which the session support apparatus acquires a set of status transition information indicating that a player of at least one of the session terminals in which the detecting device has detected the performance preparatory operation has gone into the state of being able to participate in a session, and player identification information for the session terminal, from the session terminal, a status transition information transmitting module in which the session support apparatus transmits the acquired set of status transition information and player identification information to the session terminals, and a status information updating module in which each of the session terminals updates contents displayed on the display device thereof, based upon the status transition information and player identification information transmitted from the session support apparatus.

To attain the above object, in a sixth aspect of the present invention, there is provided a program for causing a computer to implement a music session support method executed by a music session system comprising a plurality of session terminals, each having a detecting device that detects a performance preparatory operation by a player, and a session support apparatus which is connected to the plurality of session terminals, for acting as a go-between for transmission and reception of music data between the plurality of session terminals, comprising a status information transmitting module in which the session support apparatus transmits sets of status information indicative of whether or not each of players is in a state of being able to participate in a session, and player identification information which identifies the players, to the session terminals, a status information display module in which each of the session terminals which have received the sets of status information and player identification information causes the display device thereof to display the status information for each of the players, a status transition information acquiring module in which the session support apparatus acquires a set of status transition information indicating that a player of a first one of the session terminals in which the detecting device has detected start of a performance by the player has gone into the state of being able to participate in a session, and player identification information for the first session terminal, from the first session terminal, and the session support apparatus acquires a set of status transition information indicating that a player of a second one of the session terminals in which the detecting device has detected stoppage of a performance by the player over a predetermined time period has gone into a state of being unable to participate in a session, and player identification information for the second session terminal, from the second session terminal a status transition information transmitting module in which the session support apparatus transmits the acquired set of status transition information and player identification information to the session terminals, and a status information updating module in which each of the session terminals updates contents displayed on the display device thereof, based upon the status transition information and player identification information transmitted from the session support apparatus.

According to the present invention, it is possible for each player who is participating in a music session to immediately recognize the situation that a player other than himself is able to participate in the music session, or the situation that he is not able thus to participate.

Furthermore, according to the present invention, although each of the players who is participating in the music session is able to inform changes of his own status to the other players, he is not required to take any special action in order to change over his own status.

The above and other objects, features, and advantages of the invention will become more apparent from the following detailed description taken in conjunction with the accompanying drawings.

BRIEF DESCRIPTION OF THE DRAWINGS

FIG. 4 is a diagram showing the data structure of a player registration table;

DETAILED DESCRIPTION OF THE EMBODIMENTS

The present invention will now be described in detail with reference to the drawings showing preferred embodiments thereof.

Figure 1:
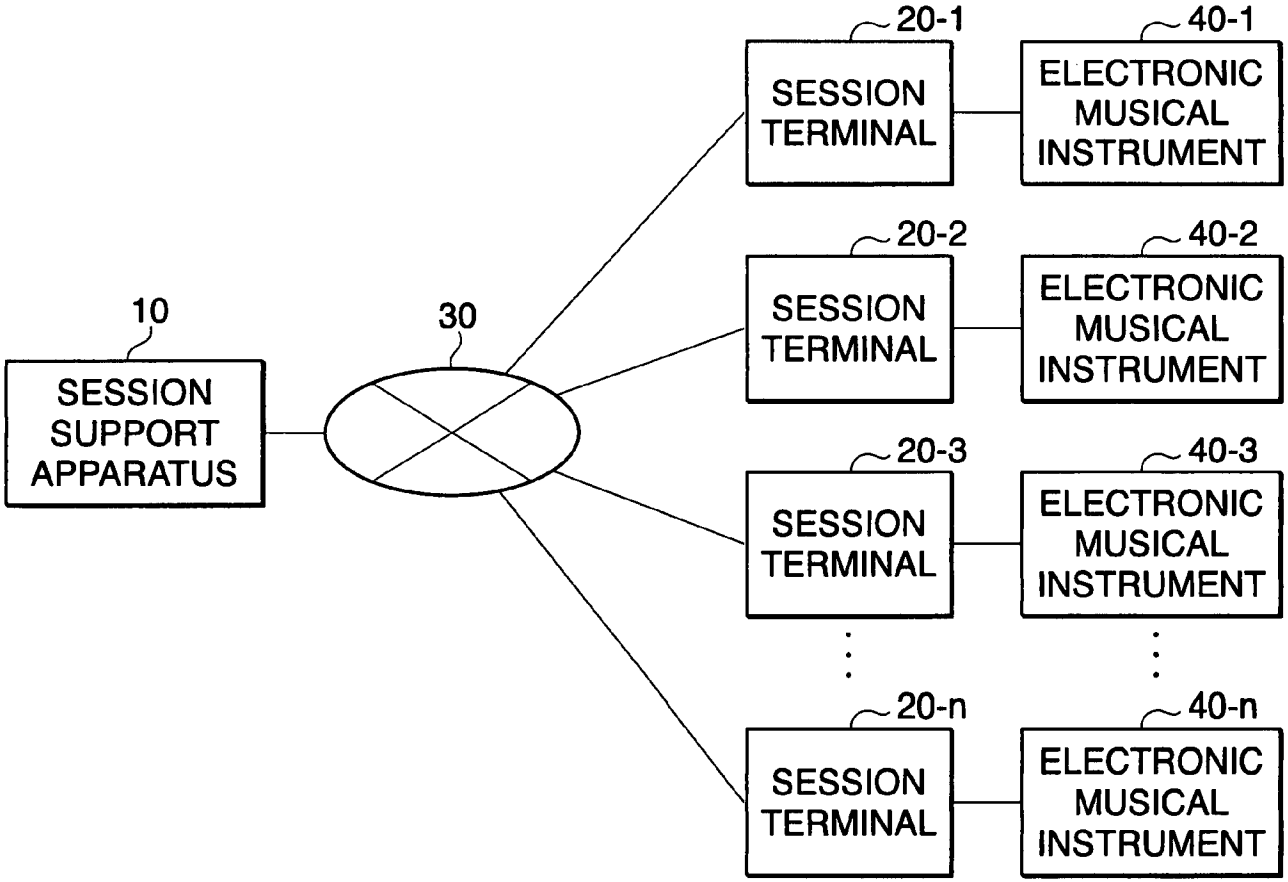
FIG. 1 is a block diagram schematically showing the construction of a music session system to which is applied a music session support method according to a first embodiment of the present invention.

FIG. 1 is a block diagram schematically showing the construction of a music session system to which is applied a music session support method according to a first embodiment of the present invention.

The present embodiment is characterized in that, when a music session is performed between several electronic musical instruments which are remote to one another, an icon display is provided for each of the players of respective electronic musical instruments, to indicate whether or not each of the players other than himself is in a state in which he is able to participate in the music session.

In the present embodiment, "player" means a person who took a predetermined registration procedure with the administrator of the music session system and has received delivery of an ID (player identification information) for identifying the person. Each of these players notifies the other players of his own ID verbally or via electronic mail or the like, or comes to know the IDs of other players, before setting up and performing a music session with those other players.

In FIG. 1, the music session system is comprised of a session support apparatus 10 which functions as a server, electronic musical instruments 40-1 through **40-*n* (where n is an integer) each of which is provided with sessions terminal 20-1 through 20-*n* which functions as clients, and a network 30 which connects together the session support apparatus 10 and the session terminals 20-1 through 20-*n*. The session terminals 20-1 through 20-*n* are connected to respective corresponding ones of the electronic musical instruments 40-1 through 40-*n* via buses. A multi player music session by a plurality of players is implemented by each of the session terminals 20** transmitting and receiving MIDI (musical instrument digital interface) data with the other session terminals thereof.

Figure 2:
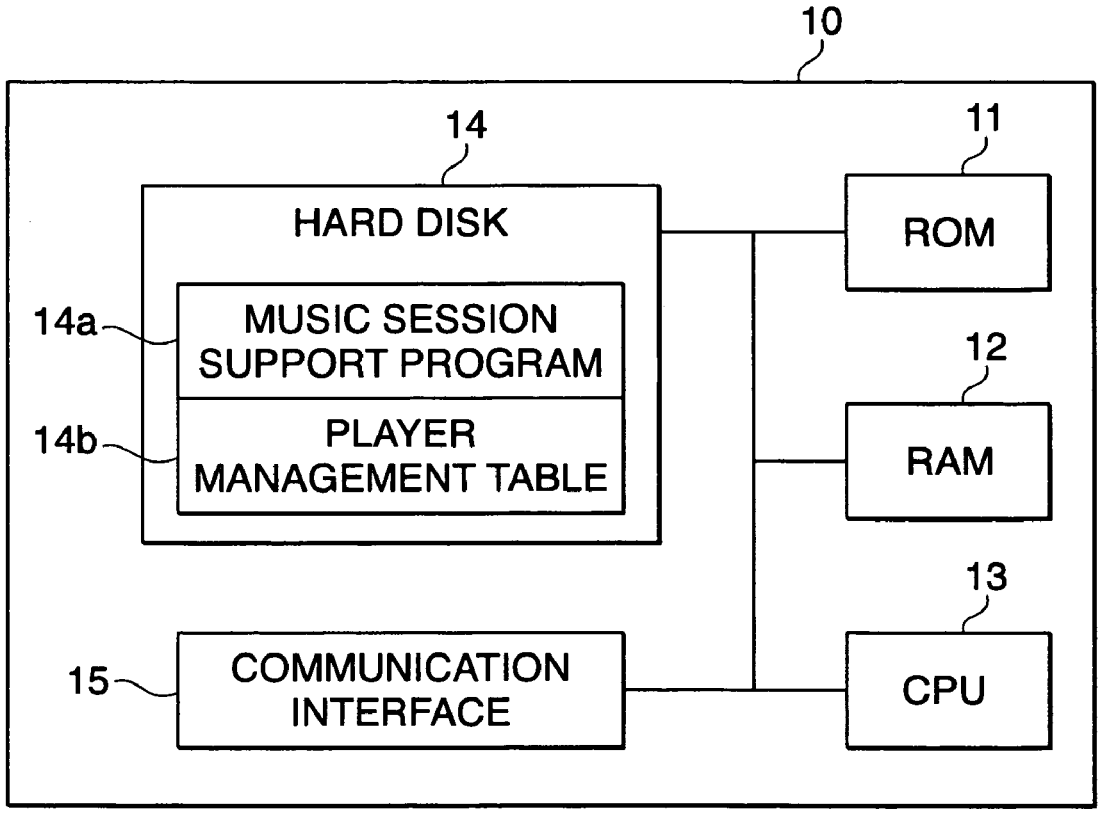
FIG. 2 is a block diagram showing the construction of a session support apparatus.

FIG. 2 is a block diagram showing the construction of the session support apparatus 10. As shown in FIG. 2, the session support apparatus 10 is comprised of a ROM 11, a RAM 12, a CPU 13, a hard disk 14, and a communication interface 15. Apart from an OS, not shown, the hard disk 14 stores a music session support program **14*a* which causes the CPU 13 operations peculiar to the present embodiment, a player management table 14*b***, and so forth.

The player management table **14*b* is a collection of a plurality of records each of which corresponds to one of the players. Each of the records constituting the table includes a field "ID", a field "address", and a field "status". In the field "ID", there is stored player identification information indicative of IDs allotted to the players. In the field "address", there is stored the address of the session terminal 20 for the corresponding player. In the field "status", there is stored status information indicative of whether or not the corresponding player is in the state of being able to participate in the session. This status information can assume one of four states: "off-line" which means that no connection for the session terminal 20 for this player is currently established with the session support apparatus 10; "present" which means that a connection is currently established for this player and moreover he is currently in the state of being able to engage in a session with other players; "absent" which means that, although a connection for the session terminal 20 for this player is currently established, he is currently in the state of not being able to participate in a session with other players due to having left his electronic musical instrument 40**, or some other reason; and "session in progress" which means that this player is already currently engaging in a session with one or more other players.

Figure 3:
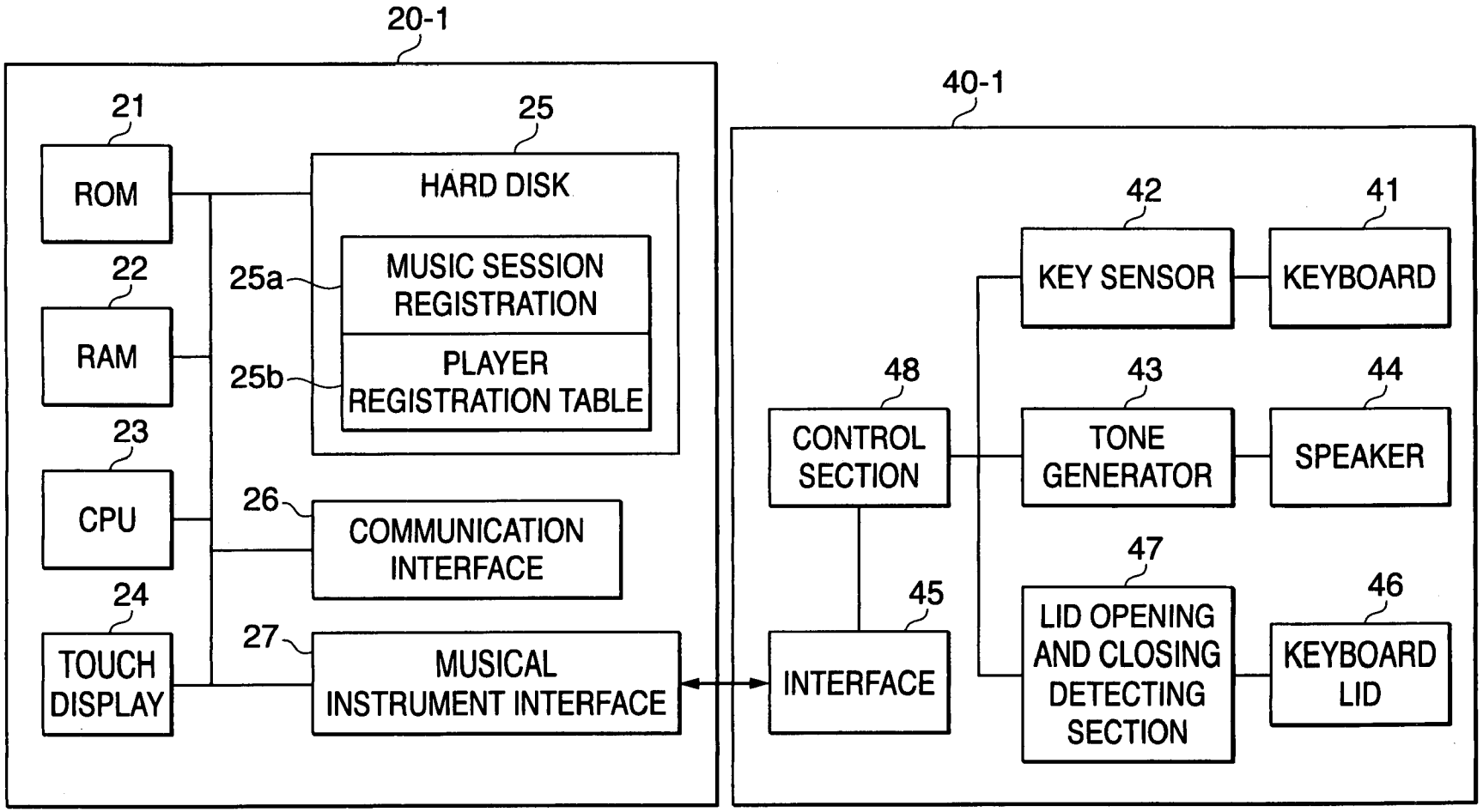
FIG. 3 is a block diagram showing the hardware configurations of a session terminal and an electronic musical instrument 40 connected thereto.

FIG. 3 is a block diagram showing the hardware configurations of one session terminal 20-1 and the electronic musical instrument 40-1 which is connected to the session terminal 20-1. The session terminal 20-1 is comprised of a ROM 21, a RAM 22, a CPU 23, a touch display 24, a hard disk 25, a communication interface 26, a musical instrument interface 27, and others.

The hard disk 25 stores a music session program **25*a* which causes the CPU 23 to perform the operations which are peculiar to the present embodiment, and a player registration table 25*b***.

The player registration table **25*b*** is for managing the names and IDs of the other players who have been registered according to a player registration process which will be described hereinafter.

FIG. 4 is a diagram showing the data structure of the player registration table **25*b*. One of the records which constitute the player registration table 25*b* consists of a field "nickname" in which are stored the nicknames of other players, and a field "ID" in which are stored the player identification information for these players. Records are added one at a time to the player registration table 25***b* each time the player registration process, described hereinafter, is executed. Each of the players is able to make a music session application for the other players whose player identification information is registered in their own player registration tables 25*b*.

On the other hand, the electronic musical instrument 40-1 is an electronic piano and is comprised of a keyboard 41, a key sensor 42, a tone generator 43, a speaker 44, an interface 45, a keyboard lid 46, a lid opening and closing detecting section 47, a control section 48, and others.

When a key of the keyboard 41 of this electronic musical instrument 40-1 is depressed, a signal which indicates the key which has been depressed and the strength of the depression is transmitted from the key sensor 42 to the control section 48, and the control section 48 outputs MIDI data which is generated according to the signal to the tone generator 43. Further, the control section 48 transmits the generated MIDI data to the session terminal 20-1 via the interface 45, and on the other hand the control section 48 outputs MIDI data which has been received via the same interface 45 to the tone generator 43. Consequently, both a music signal which has been obtained by converting the MIDI data which has been generated by the control section 48 itself, and also music signals which have been obtained by converting MIDI data which have been received from the other electronic musical instruments 40, are outputted from the tone generator 43.

Figure 5:
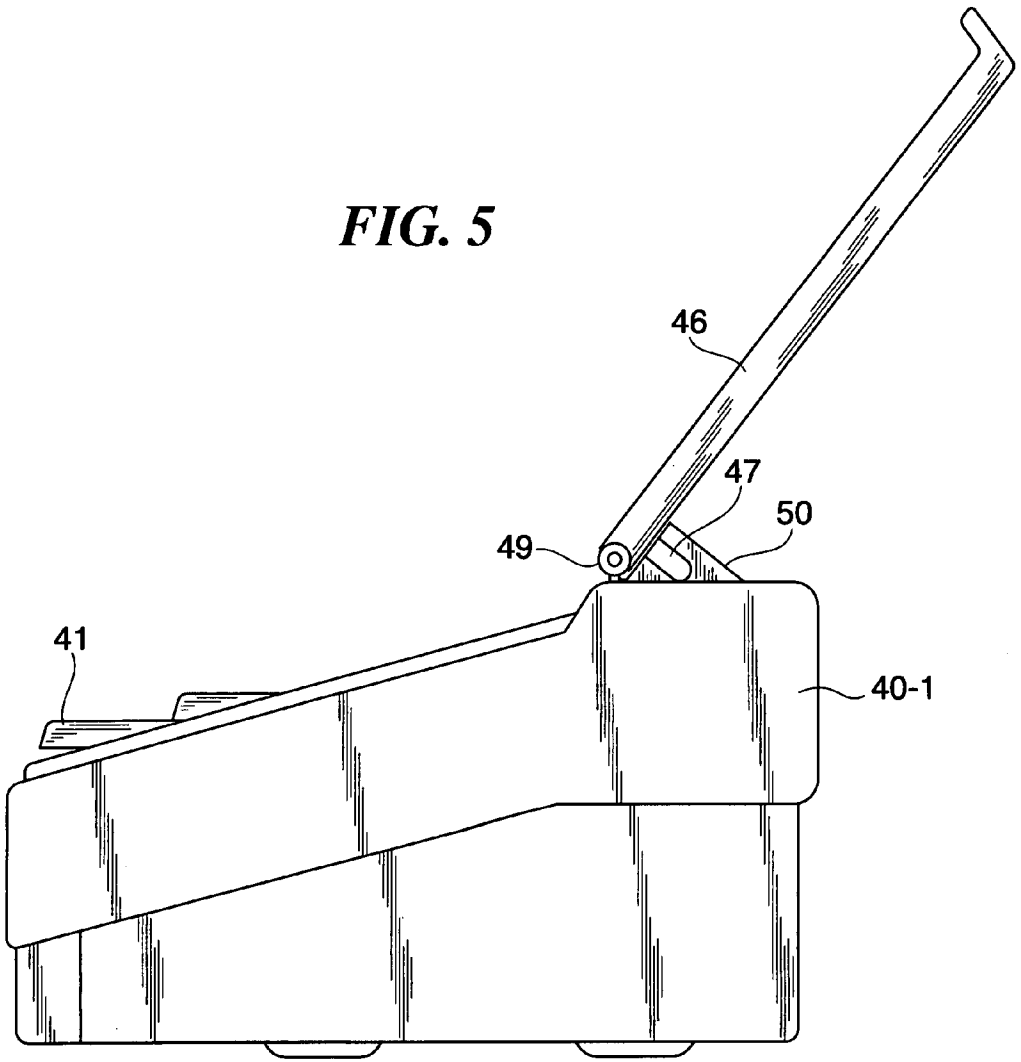
FIG. 5 is a side view showing an electronic musical instrument with a lid thereof being opened.
Figure 6:
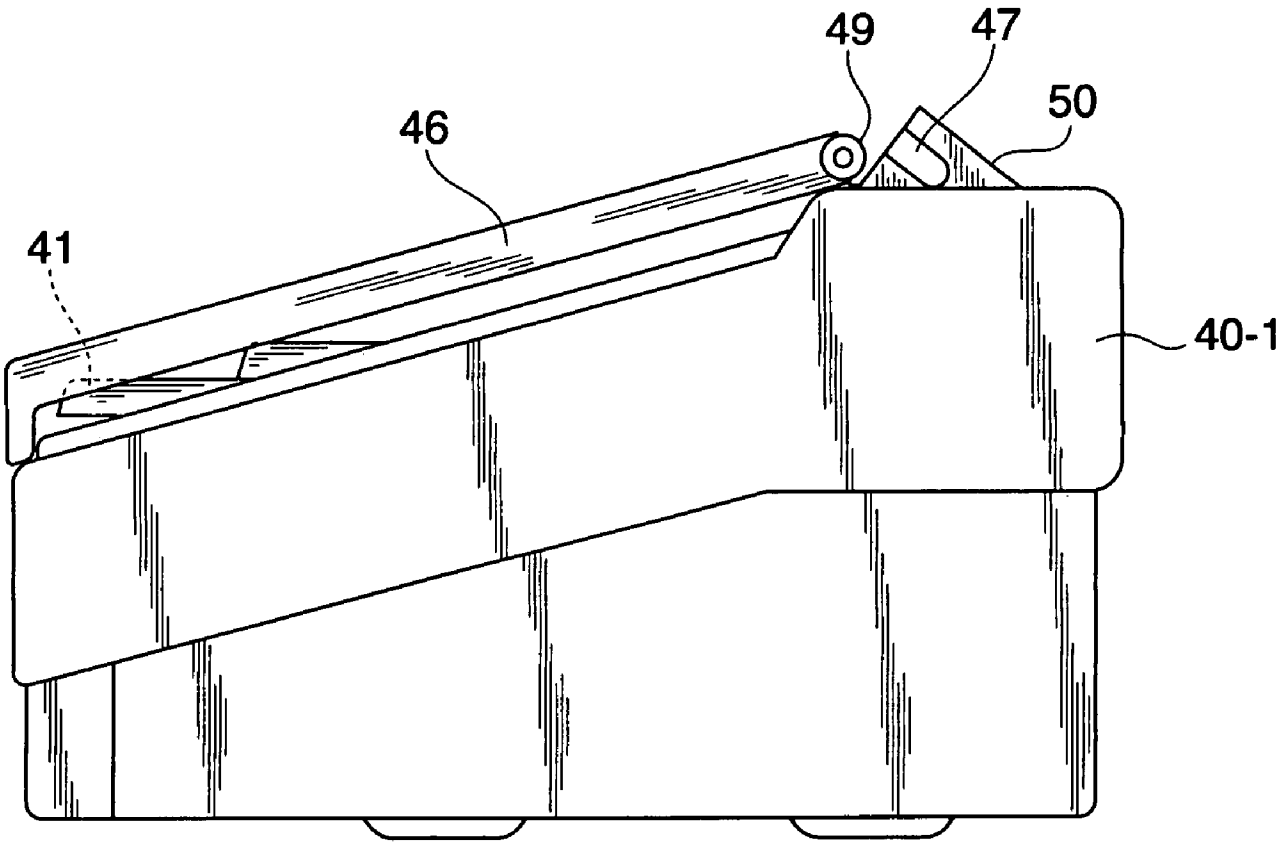
FIG. 6 is a side view showing an electronic musical instrument with a lid thereof being closed.

The keyboard lid 46 is a plate-shaped member formed of a composite resin material. The lid opening and closing detecting section 47 is an optical sensor which detects whether the keyboard lid 46 is opened or closed. Now, the way in which the lid opening and closing detecting section 47 detects the opening and closing of the keyboard lid 46 will be described with reference to FIGS. 5 and 6. FIG. 5 is a side view showing the electronic musical instrument 40-1 with a lid thereof being opened, while FIG. 6 is a side view showing the state in which the lid is closed. As shown in FIGS. 5 and 6, the keyboard 41 is disposed in a front portion of the main body of the electronic musical instrument 40-1 toward the player such that it is positioned below the keyboard lid 46 when the lid 46 is closed, and it is exposed upwards, when the lid 46 is opened. On the other hand, at a rear portion of the main body of the electronic musical instrument 40-1 remote from the player, there are provided an axle 49 upon which the keyboard lid 46 is hinged and a stopper 50 which stops the rotation of the keyboard lid 46 about the axle 49 at a predetermined position. The lid opening and closing detecting section 47 is mounted on the stopper 50. When the fact that the keyboard lid 46, which had previously been covering the keyboard 41, has been rotated to a position in which it contacts against the stopper 50 is detected by the lid opening and closing detecting section 47, a signal which indicates that the lid has been moved to its opened position is transmitted to the session terminal 20-1 via the interface 45. On the other hand, when the fact that the keyboard lid 46 has been moved from its position in which it contacts against the stopper 50 is detected by the lid opening and closing detecting section 47, a signal which indicates that the lid has been moved to its closed position is transmitted to the session terminal 20-1.

Each of the other session terminals 20-2 through 20-*n* has the same construction as the session terminal 20-1 described above, and further each of the other electronic musical instruments 40-2 through 40-*n* has the same construction as the electronic musical instrument 40-1 described above.

Next, a description will be given of the operation of the music session system incorporating the musical instrument for music sessions according to the present embodiment.

The operation of the music session system according to the present embodiment is basically comprised of a startup process, a session application process, a player registration process, and a session pause process. In the following, the startup process, session application process, player registration process, and session pause process will be described in the mentioned order. The following description relates to the operations of the electronic musical instrument 40-1 and the session terminal 20-1, but the operations of the other electronic musical instrument 40-2 through 40-*n* and session terminals 20-2 through 20-*n* are identical.

Figure 7:
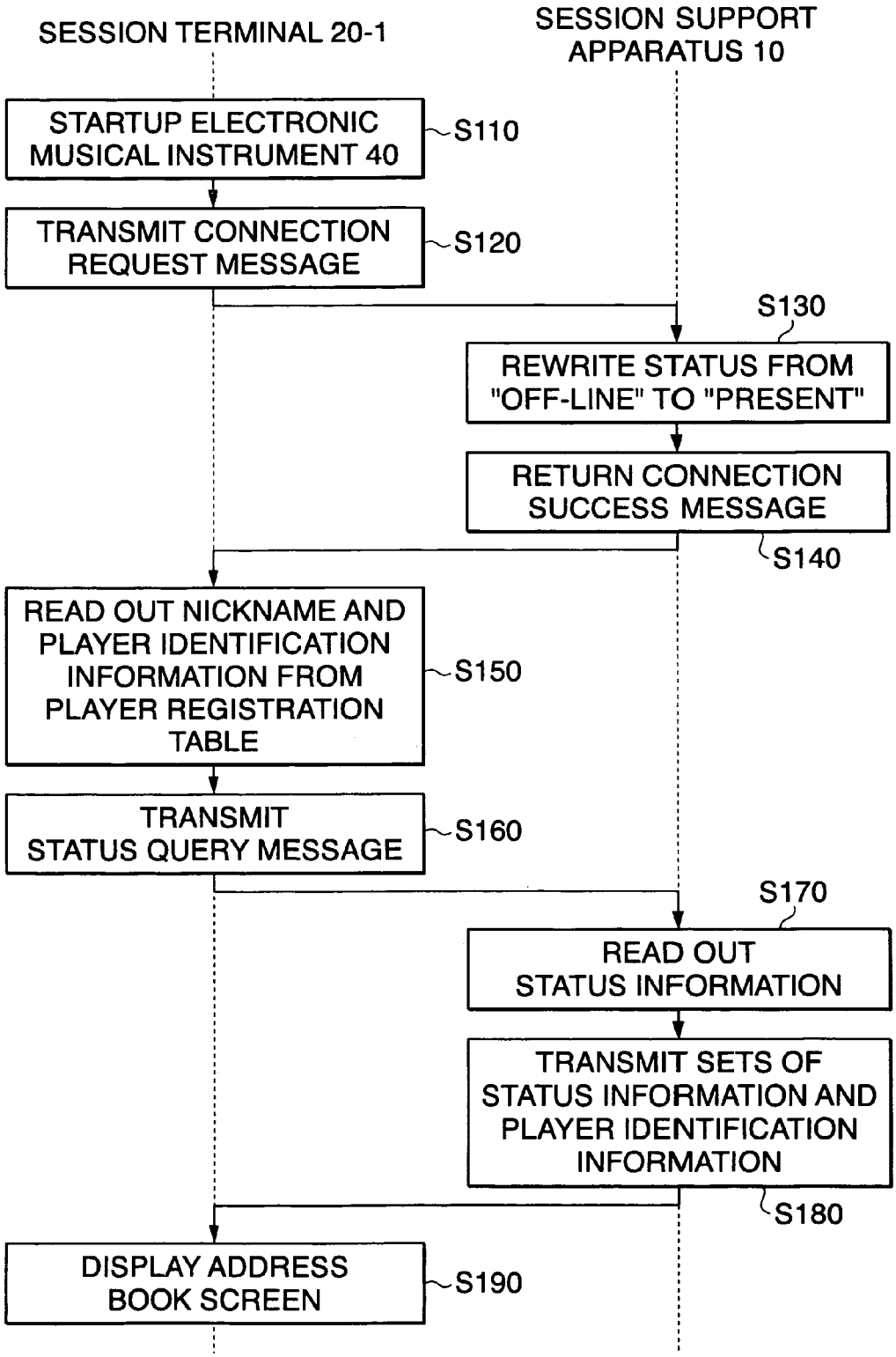
FIG. 7 is a flow chart showing a startup process.

FIG. 7 is a flow chart showing the startup process.

This process is started upon being triggered by electrical power being supplied to the session terminal 20-1 from a power source, not shown. It should be noted that, before supplying the electrical power, the player makes preparation for his performance in advance by rotating the keyboard lid 46 of the electronic musical instrument 40-1 as far as a position in which it comes into contact with the stopper 50.

Referring to FIG. 7, when electrical power is supplied to the session terminal 20-1, the CPU 23 of the session terminal 20-1 causes electric power to be supplied to the electronic musical instrument 40-1 to start up the same (step S110). At this time, since due to the actions of preparation by the player the keyboard lid 46 of the electronic musical instrument 40-1 is in contact with the stopper 50, a signal that indicates that the lid 46 is in the opened state is transmitted from the electronic musical instrument 40-1 to the session terminal 20-1.

Then, the CPU 23 transmits a connection request message which includes the player identification information for this player to the session support apparatus 10(step S120).

The CPU 13 of the session support apparatus 10 which has received the connection request message specifies a record from the player management table 14*b* which corresponds to the player identification information included in the message, and rewrites the field "status" of the specified record from "off-line" to "present" (step S130). After this, a message to the effect that the connection has been successful is returned (step S140).

The CPU 23 of the session terminal 20-1 reads out from the RAM 22 sets of nickname and player identification information which are stored in the records of the player registration table 25*b* stored in the hard disk 25 (step S150). Then, the CPU 23 transmits a status query message containing the pieces of player identification information read out to the session support apparatus 10 (step S160).

The CPU 13 of the session support apparatus 10 which has received the status query message specifies from the player management table 14*b* respective records which correspond to the pieces of player identification information included in the message, and reads out status information which is stored in the specified records (step S170). Then, the CPU 13 transmits sets of the status information and the player identification information to the session terminal 20-1 (step S180).

The CPU 23 of the session terminal 20-1 stores the received sets of the player identification information and the status information in the RAM 22, and displays an address book screen which has been created using these information on the touch display 24 (step S190).

Figure 8:
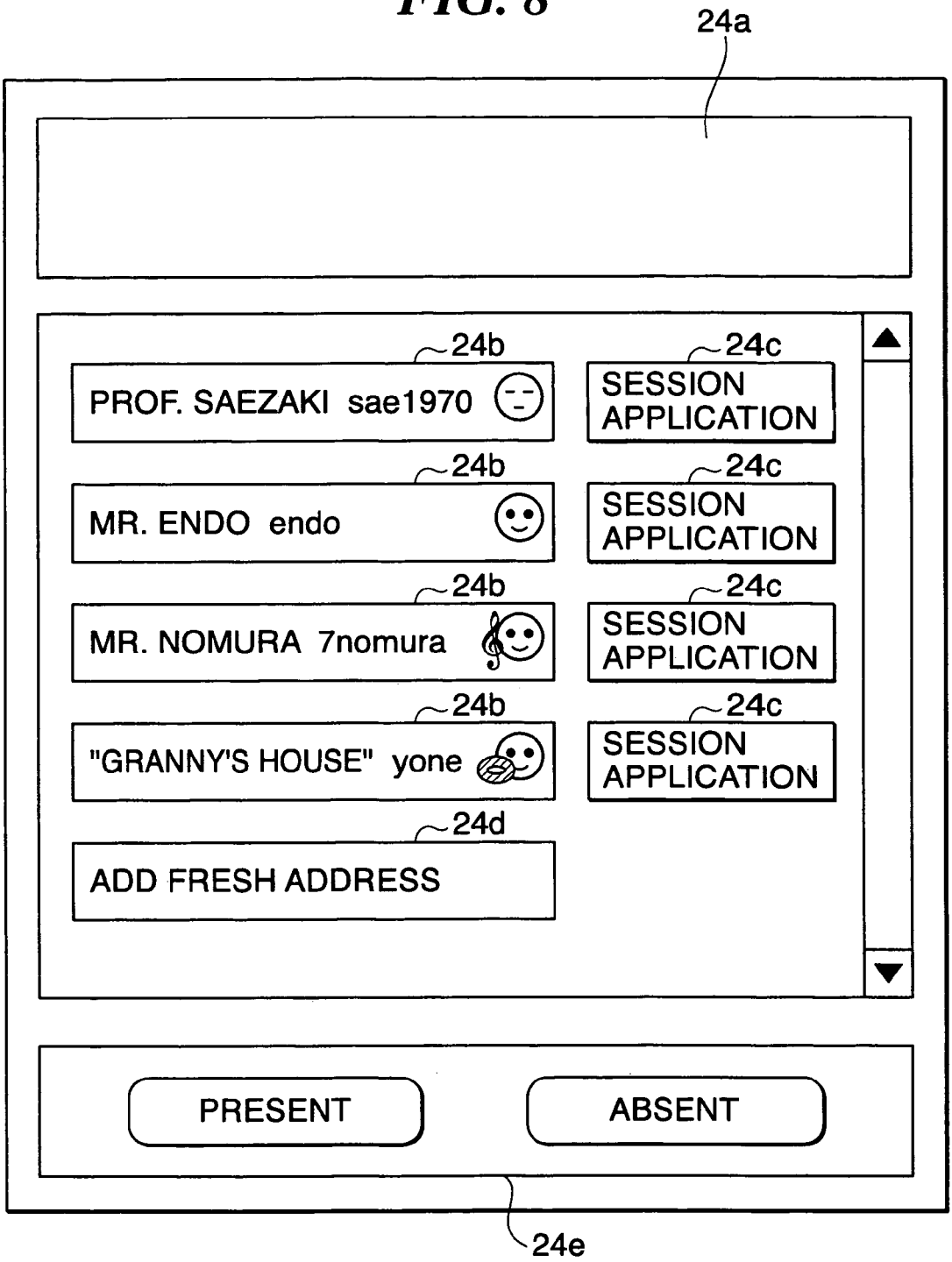
FIG. 8 is an example of an address book screen.

FIG. 8 is an example of the address book screen. In an upper portion of the address book screen there is displayed a dialog display field 24*a* which displays session application messages from the other players and so on. Player display fields 24*b* are displayed at the middle of the address book screen. In these fields there are displayed, for each of the players who are registered in the player registration table 25*b*, the nickname, the player identification number, and the status of the player.

It should be noted that, the status is displayed in the form of an icon representing an image indicative of one of "off-line", "present", "absent", and "session in progress". The icons which represent these statuses are as follows. First, the status "off-line" is represented by an icon which is the image of the face of a person who is asleep. The status "present" is represented by an icon which is the image of the face of a person who is smiling. The status "absent" is represented by an icon in which a "No Entry" traffic sign is superimposed upon a portion of the face of a person who is smiling, while the status "session in progress" is represented by an icon in which a G clef is positioned at the left side of the face of a person who is smiling.

On the right side of each of the player display fields 24*b* there is displayed a button 24*c* on which "session application" is written. These buttons 24*c* are for proposing participation in a music session to a player whose status is "present" or "session in progress". It should be noted that, if the status of a player is "off-line" or "absent", then the button which is to the right of his player display field 24*b* is locked so that it cannot be pressed. When one of the buttons 24*c* for "session application" is pressed, a process for session application which will be described hereinafter is started. In a lower central portion of the address book screen, there is displayed a button 24*d* on which is written "add new address". This button is for adding a new record to the player registration table 25*b*. When the button is pressed, a process for player registration which will be described hereinafter is started.

In a lower portion of the address book screen, there is displayed a field 24*e* for displaying the status of the player who is using the session terminal 20-1 himself. In the field 24*e*, two status bars for "present" and "absent" respectively are displayed. On the initial display which is provided on the address book screen, "present" is highlighted. However, as described in detail hereinafter, when it is detected by the lid opening and closing detecting section 47 that the lid 46 has been brought into the closed state, "absent" is immediately highlighted.

After the address book screen has been displayed on the touch display 24 in the step S190, the CPU 23 of the session terminal 20-1 transmits status query messages to the session support apparatus 10 at predetermined time intervals, for example every 20 seconds, and captures status information about the other players at these time points. When the status of any one of the other players changes, then the display contents of his own address book screen are changed in accordance with the status which has been changed.

Figure 9:
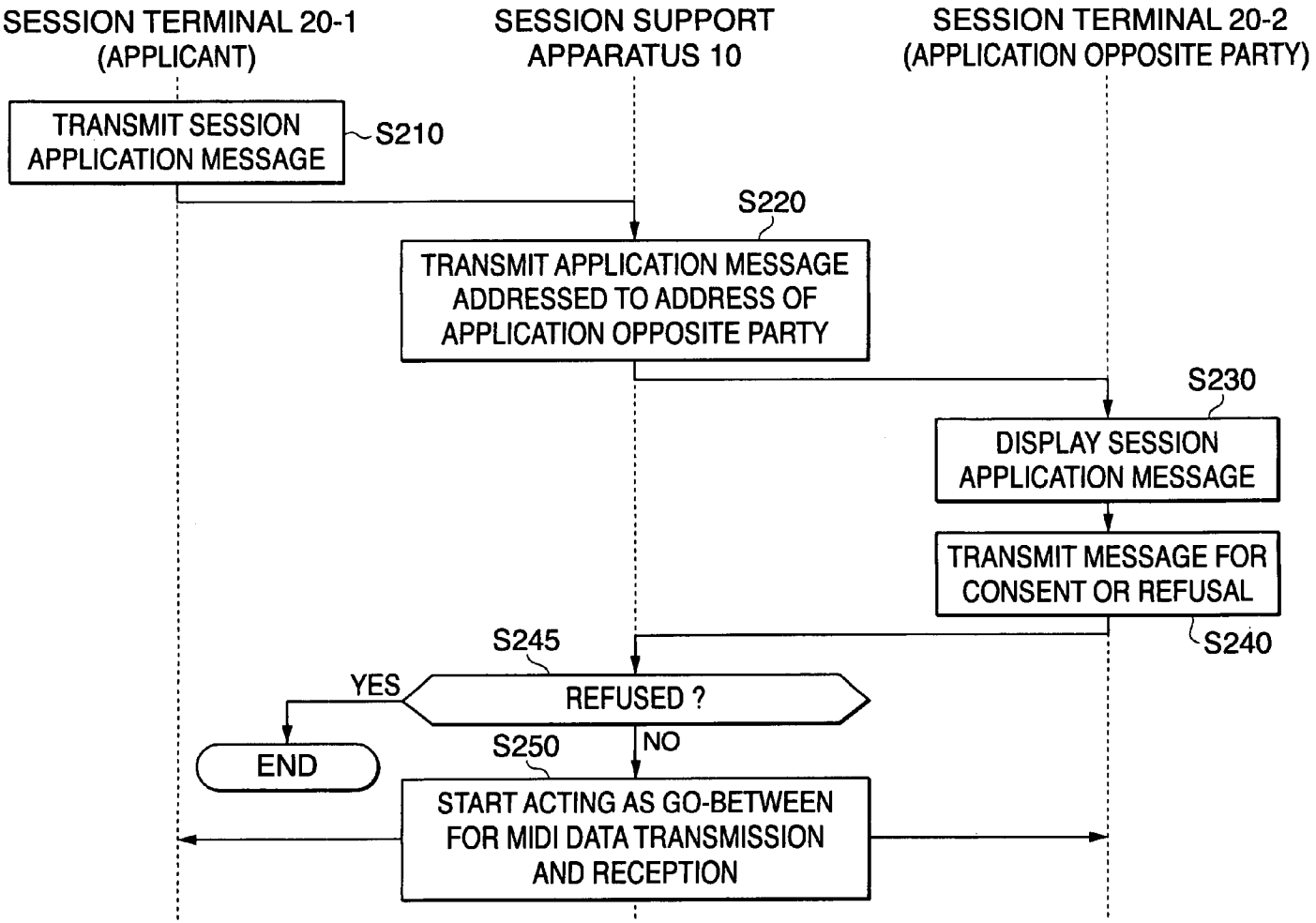
FIG. 9 is a flow chart showing a session application process.

FIG. 9 is a flow chart showing the session application process. In the following, a description will be given of the session application process in the case where the session terminal 20-1 makes a session application to the session terminal 20-2.

The session application process starts upon being triggered by one of the buttons 24*c* for "session application" being pressed, in the state in which the address book screen is being displayed as shown in FIG. 8.

When the button 24*c* for "session application" is pressed, the CPU 23 of the session terminal 20-1 transmits to the session support apparatus 10 an application message which includes the player identification information for the player who has been selected as the opposite party for the session application (step S210).

The CPU 13 of the session support apparatus 10 which has received the application message reads out from the player registration table 25*b* an address which corresponds to the player identification information included in the message, and transmits an application message which is addressed to this address (step S220).

The CPU 23 of the other session terminal 20-2 which has received the application message displays upon its touch display 24 a message saying "A session application has arrived from Mr. OOO. Accept this application?" and two buttons on which "YES" and "NO" are respectively written (step S230).

According to the selection of the player, the CPU 23 of the session terminal 20-2 which has received the application message transmits a message which indicates that he consents or that he refuses, to the session support apparatus 10 (step S240).

Next, a determination is made as to whether or not the session application has been refused by the session terminal 20-2 (step S245), and if the session application has not been refused, in other words, if a message has been received that indicates consent, then the CPU 13 of the session support apparatus 10 transfers the same message to the session terminal 20-1 which made the application, and thereafter starts to act as a go-between for transmission and reception of MIDI data to and from between the session terminal 20-1 and the session terminal 20-2 (step S250). By doing this, a music session is implemented between the players who are remote from one another.

On the other hand, if the session application has been refused, in other words, if a message has been received that indicates refusal (YES to the step S245), then the CPU 13 of the session support apparatus 10 transfers the same message to the session terminal 20-1 which made the application, and then the process is terminated.

Here, when the go-between procedure by the session support apparatus 10 has started for MIDI data transmission and reception, the CPU 23 of the session terminal 20-1 displays a session-in-progress screen on its touch display 24. Further, the CPU 23 of the session terminal 20-2 displays a session-in-progress screen on its touch display 24.

Figure 10:
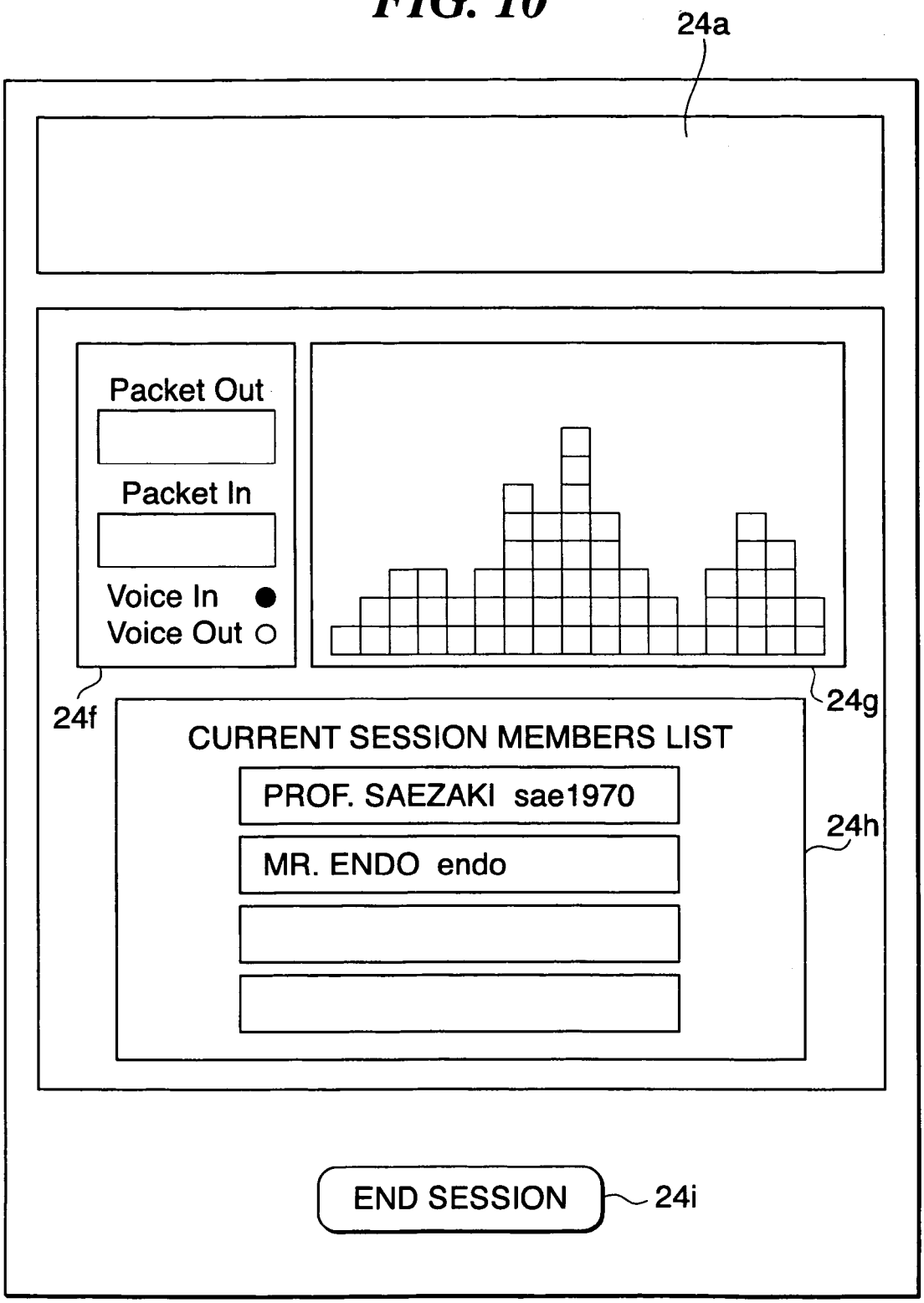
FIG. 10 is a view showing a session-in-progress screen.

FIG. 10 is a view showing an example of the session-in-progress screen displayed on the touch screen of the session terminal 10. In the following, by way of example, the session-in-progress screen will be described which is displayed upon the touch display 24 of the session terminal 20-1 when a session is taking place between the electronic musical instrument 40-1 and any two from among the electronic musical instruments 40-2 through 40-*n*.

Referring to FIG. 10, a dialog display field 24*a* is displayed at an upper portion of the session-in-progress screen, and displays session application messages from the other players in the same manner as the address book screen. At a middle left side of the screen, there is provided a field 24*f* which shows the state of data transmission and receipt. When MIDI data has been received from another session terminal 20, an indicator at the right side of "Voice In" is lit and also a numerical value indicative of the amount of data (the number of packets) which has been received is displayed in a field below "Packet In". On the other hand, when MIDI data is being transmitted from the session terminal 20-1, an indicator at the right side of "Voice Out" is lit and also a numerical value indicative of the amount of data (the number of packets) which has been transmitted is displayed in a field below "Packet Out". Further, in a central portion of the screen, there is displayed a level meter 24*g* which indicates the level of a voice sound which is being outputted from the tone generator 43. In a lower central portion of the screen, there is displayed a session member display field 24*h*. In this field, there are displayed the nicknames and IDs of the other players who are participating in this session together. Furthermore, below the session member display field 24*h*, there is displayed a button 24*i* on which is written "End Session". When this button is pressed, the session ends, and the above described address book screen is again displayed.

Figure 11:
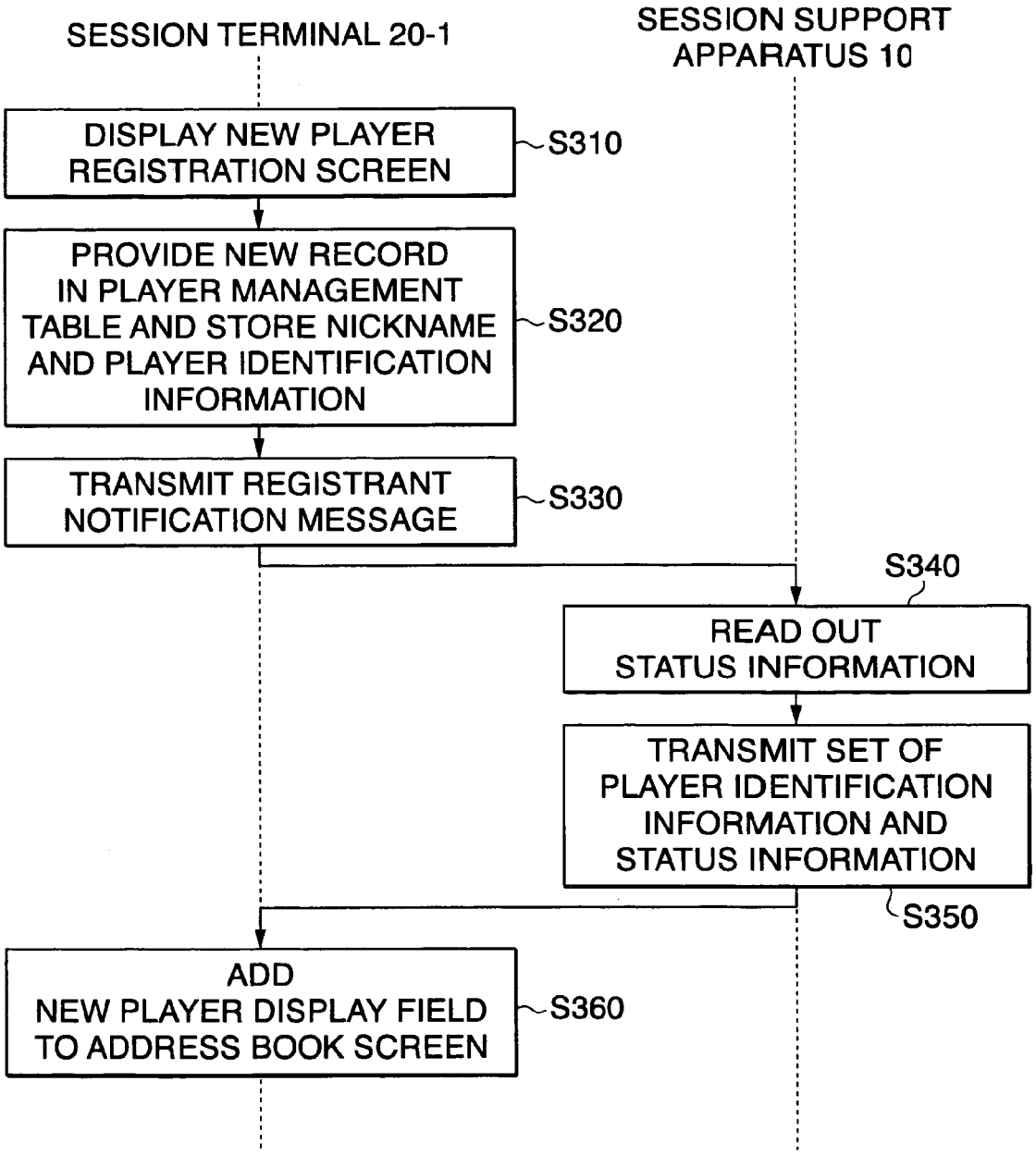
FIG. 11 is a flow chart showing a player registration process.

FIG. 11 is a flow chart showing the player registration process.

The player registration process is started upon being triggered by the "add new address" button 24*d* being selected in the state in which the address book screen shown in FIG. 8 is being displayed.

When "add new address" is selected, the CPU 23 of the session terminal 20-1 displays a new player registration screen on the touch display 24 (step S310).

Figure 12:
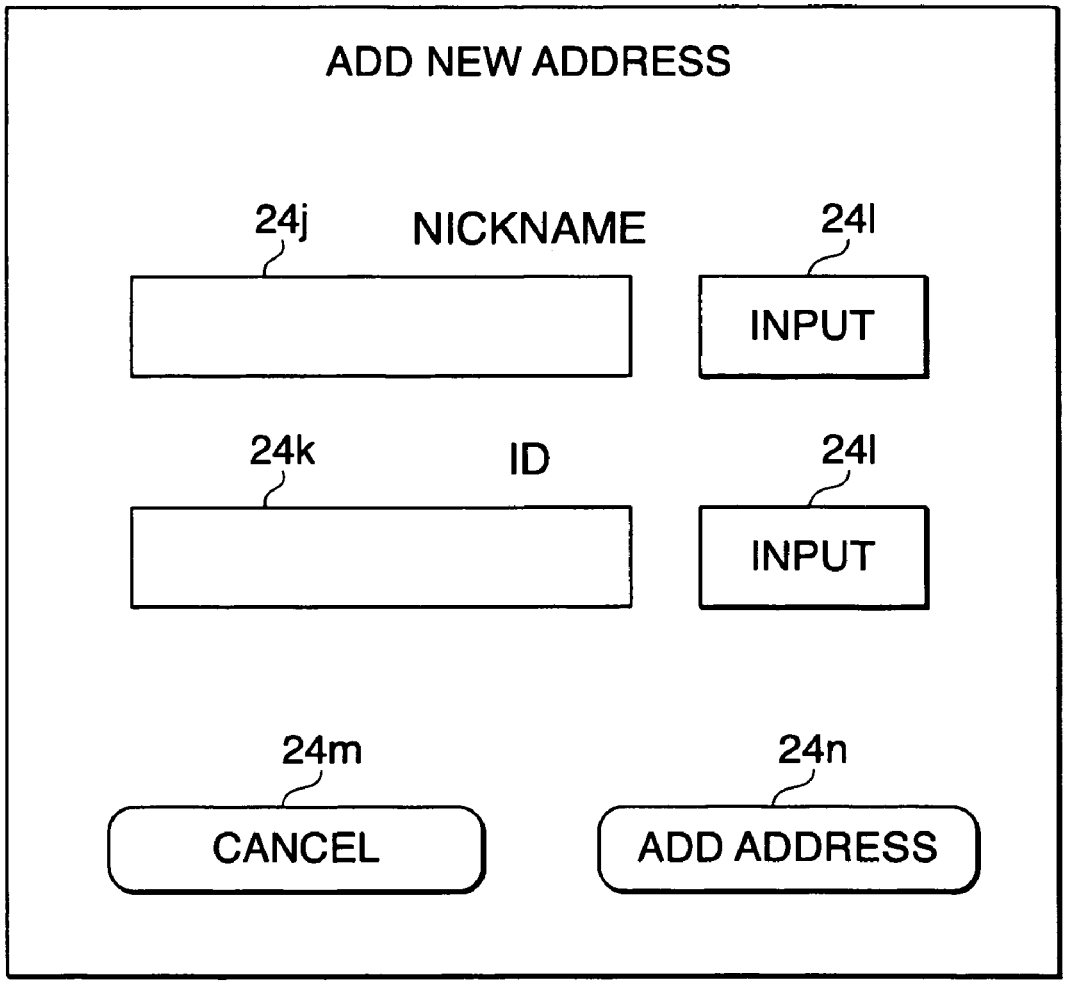
FIG. 12 is a view showing a new player registration screen.

FIG. 12 is a view showing the new player registration screen. At an upper portion of the screen, "Add New Address" is displayed, and below this a nickname input field 24*j* and an ID input field 24*k* are displayed. The nickname input field 24*j* is for inputting a nickname which designates another player who is to be registered, while the ID input field 24*k* is for inputting player identification information which has been informed in advance by the other player. On the right side of these two input fields, there are displayed two buttons 24*l* on which "Input" is written. Further, at the bottom of the screen, there are displayed a button 24*m* on which is written "Cancel" and a button 24*n* on which is written "Add Address". A player who is making a new registration presses the button 24*l* on the right side of each of the input fields 24*j* and 24*k*, and causes a software keyboard screen, not shown, to be displayed. The software keyboard screen is a screen on which various forms of text such as hiragana, katakana, and alphabetic characters can be selected. The player inputs his nickname and his player identification information in the two input fields 24*j* and 24*k* by selecting text one character at a time on the software keyboard screen. When this inputting has been completed, he presses the button 24*n* on which "Add Address" is written.

Next, the CPU 23 provides a new record in the player management table 14*b*, and stores the nickname and the player identification information which have been inputted with the screen in FIG. 12 in fields of this record (step S320). Then, the CPU 23 transmits a registrant notification message including the player identification information which was stored in the new record, to the session support apparatus 10 (step S330).

The CPU 13 of the session support apparatus which has received the registrant notification message specifies from the player management table 14*b* a record which corresponds to the player identification information included in the message, and reads out status information which is stored in the field "status" of the specified record (step S340). The CPU transmits the set of the status information which has been read out and the player identification information to the session terminal 20-1 (step S350).

The session terminal 20-1 stores the received set of the status information and the player identification information in the RAM 22, and displays an address book screen to which a player display field 24*b* for the new registrant has been added, on the touch display 24 (step S360).

Figure 13:
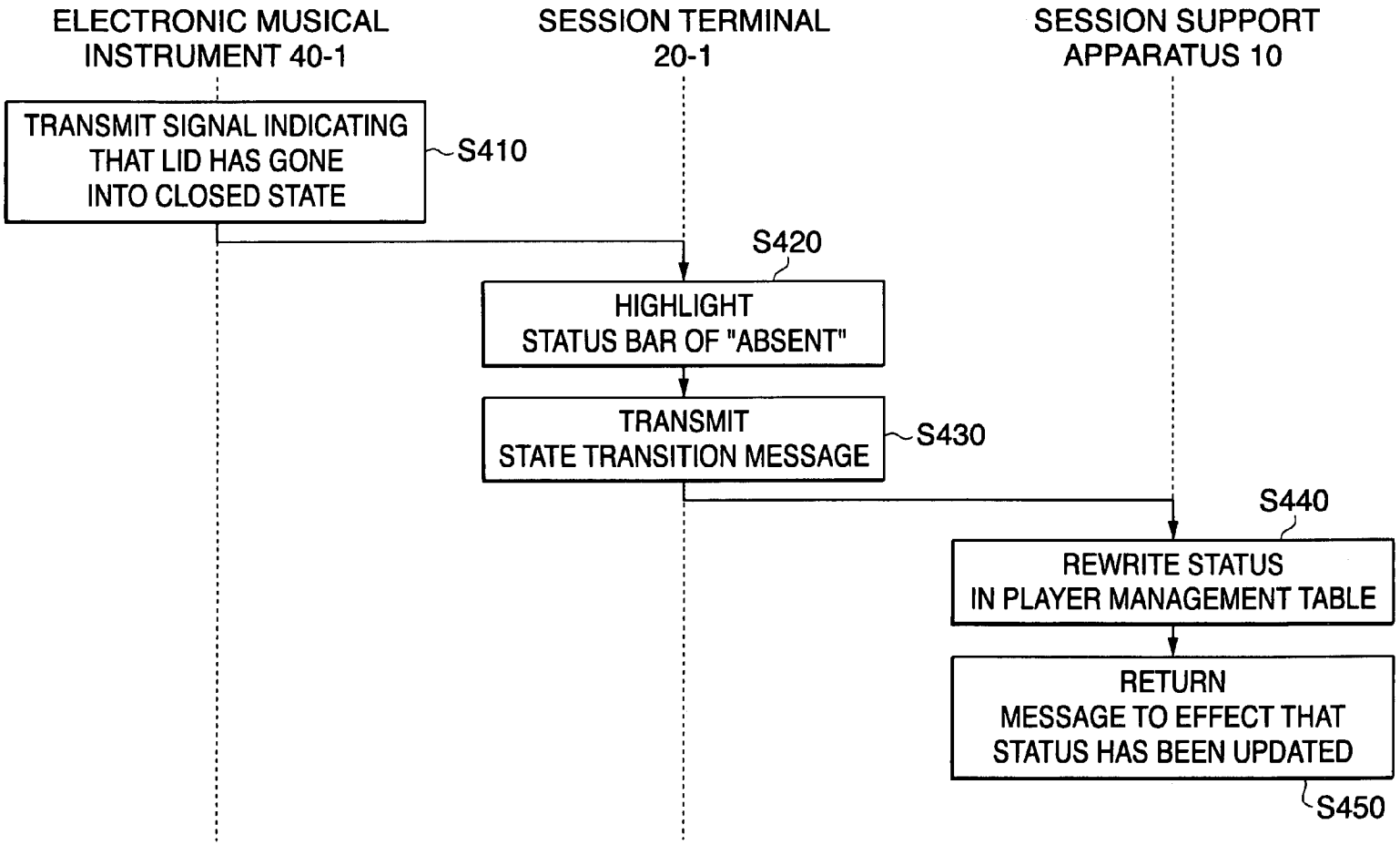
FIG. 13 is a flow chart showing a session pause process.

FIG. 13 is a flow chart showing the session pause process.

The session pause process is started upon being triggered by the lid opening and closing detecting section 47 of the electronic musical instrument 40-1 detecting that the keyboard lid 46 is in the closed state.

As described above, in the present embodiment, the startup process is started with the keyboard lid 46 of the electronic musical instrument 40-1 in the lid closed state.

When the player closes the keyboard lid 46 of the electronic musical instrument 40-1 in the state in which the address book screen is displayed as shown in FIG. 8, a signal indicating that the lid has been brought into the closed state is sent from the lid opening and closing detecting section 47 to the control section 48, and further this signal is transmitted from the control section 48 to the CPU 23 of the session terminal 20-1 (step S410).

The CPU 23 of the session terminal 20-1 which has received the signal displays on the address book screen highlights a status bar in which "absent" is written (step S420).

At the same time, the CPU transmits a state transition message which includes status information indicative of the status after the transition ("absent"), and the player identification information for the player to the session support apparatus 10 (step S430).

The CPU 13 of the session support apparatus 10 which has received this state transition message specifies from the player management table 14*b* a record which corresponds to the player identification information included in the message, and rewrites the "status" field of the specified record from "present" to "absent" (step S440). After this, the CPU 23 returns a message to the effect that the status has been updated (step S450).

On the other hand, when the player opens the keyboard lid 46 of the electronic musical instrument 40-1 again, the CPU 23 of the session terminal 20-1 highlights a status bar of "present" in the lower portion of the address book screen, and transmits a state transition message which indicates that the status has changed from "absent" to "present" to the session support apparatus 10. This causes the status in the player management table 14*b* to be rewritten again from "absent" to "present".

As described with respect to the startup process in FIG. 7, each of the session terminals 20 in the present embodiment periodically transmits a status query message to the session support apparatus 10, so as to capture the status information for the players. Accordingly, when any of the players has closed his keyboard lid 46, the fact that the status of that player has changed to "absent" is transmitted to the other players immediately via the address book screen of each of the session terminals. On the other hand, when the keyboard lid 46 is again opened, the fact that the status of that player has returned from "absent" to "present" is also immediately transmitted via the address book screen of each of the session terminals.

As described above, according to the present embodiment, a set of status information indicative of whether or not each of the players is in a state of being able to participate in a session, and player identification information which identifies the player, is transmitted from the session support apparatus 10 to each of the session terminals 20; status information for each player is displayed on the touch display 24 of each of the session terminals 20 which has received the set of status information and player identification information for each player; a set of status transition information indicative of that the player of a session terminal 20 which has detected a performance preparatory operation by the player, has gone into the state of being able to participate in a session and player identification information for that session terminal 20 is acquired from that session terminal 20 by the session support apparatus 10; the acquired set of status transition information and player identification information is transmitted to the other session terminals 20 which are connected to the session support apparatus 10; and based upon the transmitted status transition information and player identification information, the details of displays of the address book screens which are displayed on the touch displays 24 of the other session terminals 20 are updated by the other session terminals 20. As a result, each of the players who are participating in a music session is able to know directly whether or not the players other than himself are in the state of being able to participate in the music session, merely by looking at the icons which are displayed upon his address book screen.

Further, according to the present embodiment, each of the electronic musical instruments 40 through 40-*n* which is used by one of the players is provided with a sensor for detecting the opening and closing of the keyboard lid 46, and it is arranged such that when a player closes his keyboard lid 46, the status of that player is changed from "present" to "absent". As a result, each of the players can inform the other players of change of his own status, without performing any special action for changing over his status.

Next, a second embodiment of the present invention will be described. In the above described first embodiment, the electronic musical instrument 40 is provided with the lid opening and closing detecting section 47, and the status of the player is automatically changed over according to the operation of the detecting section. By contrast, the second embodiment is constructed such that a detecting means which detects a performance preparatory operation by a player is provided at a stool on which the player sits when making his performance, and the status of the player is automatically changed over according to the result of detection of the detecting means.

Figure 14:
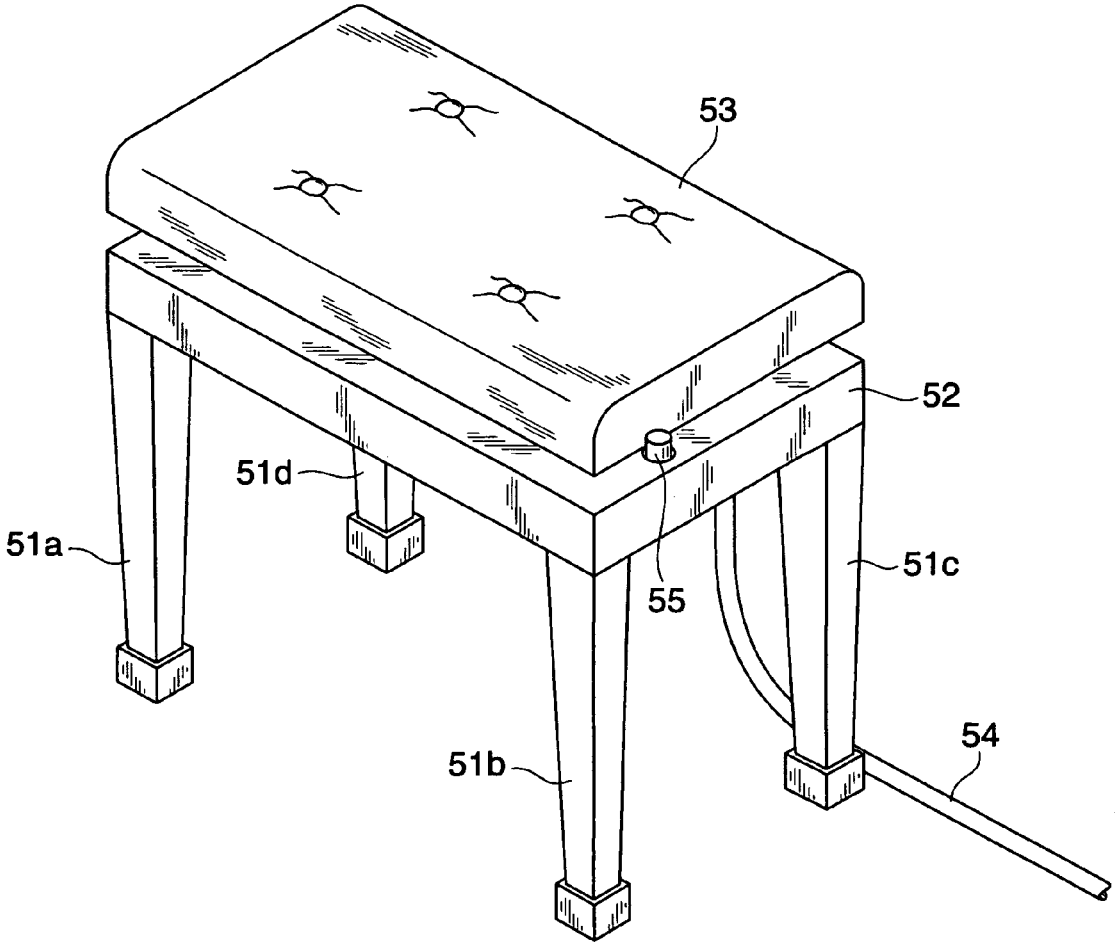
FIG. 14 is a perspective view showing the construction of a performance stool used in a music session system to which is applied a music session support method according to a second embodiment of the present invention.

FIG. 14 is a perspective view showing the construction of a performance stool 50 which is connected to the session terminal 20 in the second embodiment. The performance stool 50 is comprised of four legs 51*a* through 51*d*, a main frame 52 connecting the legs 51*a* through 51*d*, a seat portion 53 provided above the main frame 52 and connected to the main frame 52 in a manner movable relative to the same in the vertical direction, a press-button type switch 55 provided at an end of the upper surface of the main frame 52, for detecting a performance preparatory operation, and a cord 54 which is connected between the switch 55 and the session terminal 20 and transmits an electrical signal from the switch 55 to the session terminal 20.

The seat portion 53 of the performance stool 50 is biased in the upward direction by an elastic member, not shown. Accordingly, when the player sits down on the stool 50, the seat portion 53 is depressed in the downward direction to a certain extent, and the lower surface of the seat portion 53 and the upper end of the switch 55 come into contact with each other, so that the switch 55 is pressed in the downward direction. When the switch 55 is thus pressed, it goes ON and transmits a signal indicative of the player sitting on the performance stool 50 via the cord 54 to the session terminal 20. On the other hand, when the upper end of the switch 55 is separated from the lower surface of the seat portion 53 by the player standing up from the performance stool 50, the switch 55 goes from ON to OFF and transmits a signal indicative of the player having stood up via the cord 54 to the session terminal 20.

Next, the operation of the second embodiment will be described.

The operation of the second embodiment as well, just like that of the first embodiment described above, is broadly comprised of a startup process, a session application process, a player registration process, and a session pause process. Among these processes, only the details of the session pause process are different from those in the first embodiment. Description of those which are identical with those in the first embodiment is therefore omitted and only those which are different will be described below.

The session pause process of the second embodiment starts upon being triggered by changing over of the switch 55 of the stool 50 from ON to OFF.

When the player stands up from his performance stool 50 to pause his performance, a signal indicative of the player having stood up is transmitted from the performance stool 50 to the session terminal 20-1. When the session terminal 20-1 receives this signal, the processing from the step S420 et seq. shown in FIG. 13 is executed. On the other hand, when the switch 55 goes from the OFF state to the ON state due to the player sitting down upon the performance stool 50, then the status again returns from "absent" to "present".

As described above, according to the present embodiment, when the switch 55 of the performance stool 50 which is connected to the session terminal 20 changes over from "ON" to "OFF", then the status in the player management table 14*b* is rewritten from "present" to "absent", while, when the switch 55 of the performance stool 50 changes over from "OFF" to "ON", then the above described status is again rewritten from "absent" to "present". As a result, the players are not required to take any special action in order to change over their status. Rather, it is possible for the players to inform the other players of changes in their own status without performing any special operation for changing over the status.

Next, a third embodiment of the present invention will be described. The above described first and second embodiments are constructed such that a detecting means for detecting whether or not the player has performed a performance preparatory operation is provided in the electronic musical instrument 40 or in the performance stool 50, and the status of the player is automatically changed over according to the output from the detecting means. By contrast, the third embodiment is constructed such that when the keyboard 41 has not been depressed for a predetermined time period, the status of the player is changed over from "present" to "absent", while when the keyboard 41 is depressed again subsequently, the status of the player returns from "absent" to "present".

The third embodiment is the same in construction as the first embodiment, except that no lid opening and closing detecting section 47 is provided in the electronic musical instrument 40. Description of those which are identical with those in the first embodiment is therefore omitted and only those which are different will be described below.

Next, the operation of the third embodiment will be described. The operation of the third embodiment as well, just like that of the first embodiment described above, is broadly comprised of a startup process, a session application process, a player registration process, and a session pause process. Among these processes, only the details of the session pause process are different from those for the first embodiment. Description of those which are identical with those in the first embodiment is therefore omitted and only those which are different will be described below.

When the startup process shown in FIG. 7 is completed, and the address book screen is displayed on the touch display 24, then the CPU 23 of the session terminal 20-1 monitors whether or not the supply of MIDI data from the electronic musical instrument 40-1 has stopped. When it is detected that the supply of MIDI data has stopped, measurement of time is started from this time point. If it is determined that a predetermined time period (for example five minutes) has elapsed from the time point at which the supply of MIDI data has stopped, the processing from the step S420 et seq. shown in FIG. 13 is executed.

When the supply of MIDI data from the electronic musical instrument 40-1 is restarted subsequently due to the player having depressed any key of the keyboard 41, then the CPU 23 of the session terminal 20-1 transmits a state transmission message which indicates that the status has changed from "absent" to "present" to the session support apparatus 10, and the status in the player management table 14*b* is rewritten by the session support apparatus 10 from "absent" to "present".

As described above, according to the present embodiment, when the predetermined time period has elapsed from the time point at which the supply of MIDI data from the electronic musical instrument 40-1 has stopped, the CPU 23 of the session terminal 20-1 rewrites the status of the player management table 14*b* from "present" to "absent", while, when the supply of MIDI data from the electronic musical instrument 40-1 is restarted by the player having depressed any key of the keyboard 41, the above described status is again rewritten from "absent" to "present". As a result, each player can inform the other players of change in his status without performing any special operation for changing over the status.

Various variations of the above described embodiments of the present invention can be implemented.

For example, although in the above described embodiments, each of the electronic musical instruments 40 connected to the session terminals 20 is a keyboard musical instrument, a music session may be performed by connecting stringed musical instruments or wind musical instruments or the like to the session terminals 20 as electronic musical instruments. With stringed musical instruments or wind musical instruments or the like, it may also happen that, as a performance preparatory operation, actions like performing opening and closing operation of a lid, or sitting down upon a stool for performance are not performed, and therefore the status may be changed over upon being triggered by detection of some other action taken by the player.

For example, with a stringed musical instrument such as a guitar, the player picks up the main body of the electronic musical instrument, and the performance is made with the instrument in the state of being clasped to the chest of the player. An inclination sensor may be mounted on the main body of the musical instrument to measure its inclination, and it may be determined that the player is in the state of being able to perform when the angle of inclination detected by the inclination sensor is greater than a certain predetermined angle.

Further, if a music session is to be performed using various musical instruments such as keyboard musical instruments, stringed musical instruments, and wind musical instruments, not only may icons which indicate the status of the other players be displayed on the address book screen, but also icons which show the type of musical instruments which the other players are using may be disposed along with the icons indicating the status of the other players. By doing this, after it has been understood what type of musical instruments the other players are using, it is possible to decide whether or not to propose a music session with these players, and, furthermore, if a session application is received from another player, it is possible to determine whether or not to respond to that application after having confirmed what type of musical instrument that player is using.

Furthermore, an icon which indicates the skill level of the other players may be displayed along with their status. As this type of variation, the following arrangements may be envisaged. First, players attend a meeting at a music school or the like held by the administrator of the system and have their skill levels attested by the administrator, and level information indicative of the levels at which the players have been attested is stored in the player management table 14*b* of the session support apparatus 10 in association with the player identification information for those players. When the session support apparatus 10 receives a status query message from one of the session terminals 20, it transmits, along with the status information, level information for that player in association with the player identification information. By causing the session support apparatus 10 to collectively manage the skill level information which indicates the skill levels of the players in this way, it is also possible to arrange so as not to permit a player to be included in a specific music session unless he is at or above a certain level, or so as to exert influence upon the music session in order to ensure that each of the players is at approximately the same level.

Although in the first embodiment described above, the means for detecting performance preparatory operation by a player is an optical type sensor, and in the second embodiment it is a switch, it is possible to detect the performance preparatory operation by the player by some different arrangement other than these. Furthermore, although in the above described embodiments, it is constructed such that the session terminals and the electronic musical instruments are provided as separate units, it is possible to provide them in the same casing.

In the above described embodiments, it is arranged such that when the status of any of the session terminals has changed, that terminal transmits a state transition message directly to the session support apparatus. However, it is not necessary for each of the session terminals to transmit a state transition message upon being triggered to do so by change of its own status. It may be arranged such that the state transition message is transmitted at some other timing. For example, a construction may be provided in which the session support apparatus inquires each session terminal at predetermined time intervals, in turn, as to whether or not any change in its state has taken place, and any status terminal for which a change in its own status has taken place returns a state transition message as a response to the inquiry.

It is to be understood that the object of the present invention may also be accomplished by supplying a system or an apparatus with a storage medium in which a program code of software which realizes the functions of any of the above described embodiments is stored, and causing a computer (or CPU or MPU or the like) of the system or apparatus to read out and execute the program code stored in the storage medium.

In this case, the program code itself read out from the storage medium realizes the new functions of the present invention described above, and hence the program and the storage medium in which the program code is stored constitute the present invention.

Examples of the storage medium for supplying the program code include a floppy (registered trademark) disk, a hard disk, an optical disk, a magneto-optical disk, a CD-ROM, a CD-R, a CD-RW, a DVD-ROM, a DVD-RAM, a DVD-RW, a DVD+RW, a magnetic tape, a nonvolatile memory card, and a ROM. Alternatively, the program may be downloaded via a network from another computer, a database or the like, not shown, connected to the Internet, a commercial network, a local area network, or the like.

Further, the functions of any of the above-described embodiments may be accomplished not only by executing a program code read out by a computer, but also by causing an operating system (OS) or the like which operates on the computer to perform a part or all of the actual operations based on instructions of the program code.

Further, it is to be understood that the functions of the above-described embodiments may be accomplished not only by executing a program code read out by a computer, but also by causing an OS (operating system) or the like which operates on the computer to perform a part or all of the actual operations based on instructions of the program code.

Further, it is to be understood that the functions of any of the above described embodiments may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

What is claimed is:

1. A music session support method executed by a music session system comprising a plurality of session terminals, each having a detecting device that detects a performance preparatory operation by a player, and a session support apparatus which is connected to the plurality of session terminals, for acting as a go-between for transmission and reception of music data between the plurality of session terminals, comprising:

a status information transmitting step in which the session support apparatus transmits sets of status information indicative of whether or not each of players is in a state of being able to participate in a session, and player identification information which identifies the players, to the session terminals;

a status information display step in which each of the session terminals which have received the sets of status information and player identification information causes the display device thereof to display the status information for each of the players;

a status transition information acquiring step in which the session support apparatus acquires a set of status transition information indicating that a player of at least one of the session terminals in which the detecting device has detected the performance preparatory operation has gone into the state of being able to participate in a session, and player identification information for the session terminal, from the session terminal;

a status transition information transmitting step in which the session support apparatus transmits the acquired set of status transition information and player identification information to the session terminals; and a status information updating step in which each of the session terminals updates contents displayed on the display device thereof, based upon the status transition information and player identification information transmitted from the session support apparatus.

2. A music session support method executed by a music session system comprising a plurality of session terminals, each having a detecting device that detects a performance preparatory operation by a player, and a session support apparatus which is connected to the plurality of session terminals, for acting as a go-between for transmission and reception of music data between the plurality of session terminals, comprising:

a status information transmitting step in which the session support apparatus transmits sets of status information indicative of whether or not each of players is in a state of being able to participate in a session, and player identification information which identifies the players, to the session terminals;

a status information display step in which each of the session terminals which have received the sets of status information and player identification information causes the display device thereof to display the status information for each of the players;

a status transition information acquiring step in which the session support apparatus acquires a set of status transition information indicating that a player of a first one of the session terminals in which the detecting device has detected start of a performance by the player has gone into the state of being able to participate in a session, and player identification information for the first session terminal, from the first session terminal, and the session support apparatus acquires a set of status transition information indicating that a player of a second one of the session terminals in which the detecting device has detected stoppage of a performance by the player over a predetermined time period has gone into a state of being unable to participate in a session, and player identification information for the second session terminal, from the second session terminal;

a status transition information transmitting step in which the session support apparatus transmits the acquired set of status transition information and player identification information to the session terminals; and a status information updating step in which each of the session terminals updates contents displayed on the display device thereof, based upon the status transition information and player identification information transmitted from the session support apparatus.

3. A musical instrument for music sessions, which implements a music session by performing transmission and reception of music data to and from one or a plurality of players, comprising:

a display device that displays status information indicative of whether or not players are in a state of being able to participate in a session, and player identification information for the players, in association with one another;

a detecting device that detects a performance preparatory operation by a player;

a transmission device operable when the performance preparatory operation has been detected by said detecting device, to transmit a set of status transition information indicating that the player has gone into the state of being able to participate in a session, and player identification information identifying the player;

a receiving device that receives sets of status transition information indicating that at least one of the one or plurality of players has gone into the state of being able to participate in a session and player identification information identifying the at least one player; and an updating device operable when the set of status transition information and player identification information has been received by said receiving device, to update contents of the status information which is displayed on said display device in association with the received player identification information.

4. A musical instrument for music sessions, which implements a music session by performing transmission and reception of music data to and from one or a plurality of players, comprising:

a display device that displays status information indicative of whether or not players are in a state of being able to participate in a session, and player identification information for the players, in association with one another;

a detecting device that detects a performance preparatory operation by a player;

a transmission device operable when the performance preparatory operation has been detected by said detecting device, to transmit a set of status transition information indicating that the player has gone into the state of being able to participate in a session, and player identification information identifying the player, said transmission device being operable when said detecting device has detected stoppage of a performance by the player over a predetermined time period, to transmit a set of status transition information indicating that the player has gone into a state of being unable to participate in a session, and player identification information identifying the player;

a receiving device that receives sets of status transition information indicating that at least one of the one or plurality of players has gone into the state of being able to participate in a session or the state of being unable to participate in a session and player identification information identifying the at least one player; and an updating device operable when the set of status transition information and player identification information has been received by said receiving device, to update contents of the status information which is displayed on said display device in association with the received player identification information.

5. A computer including a program to implement a music session support method executed by a music session system comprising a plurality of session terminals, each having a detecting device that detects a performance preparatory operation by a player, and a session support apparatus which is connected to the plurality of session terminals, for acting as a go-between for transmission and reception of music data between the plurality of session terminals, comprising:

a status information transmitting module in which the session support apparatus transmits sets of status information indicative of whether or not each of players is in a state of being able to participate in a session, and player identification information which identifies the players, to the session terminals;

a status information display module in which each of the session terminals which have received the sets of status information and player identification information causes the display device thereof to display the status information for each of the players;

a status transition information acquiring module in which the session support apparatus acquires a set of status transition information indicating that a player of at least one of the session terminals in which the detecting device has detected the performance preparatory operation has gone into the state of being able to participate in a session, and player identification information for the session terminal, from the session terminal;

a status transition information transmitting module in which the session support apparatus transmits the acquired set of status transition information and player identification information to the session terminals; and a status information updating module in which each of the session terminals updates contents displayed on the display device thereof, based upon the status transition information and player identification information transmitted from the session support apparatus.

6. A computer including a program to implement a music session support method executed by a music session system comprising a plurality of session terminals, each having a detecting device that detects a performance preparatory operation by a player, and a session support apparatus which is connected to the plurality of session terminals, for acting as a go-between for transmission and reception of music data between the plurality of session terminals, comprising:

a status information transmitting module in which the session support apparatus transmits sets of status information indicative of whether or not each of players is in a state of being able to participate in a session, and player identification information which identifies the players, to the session terminals;

a status information display module in which each of the session terminals which have received the sets of status information and player identification information causes the display device thereof to display the status information for each of the players;

a status transition information acquiring module in which the session support apparatus acquires a set of status transition information indicating that a player of a first one of the session terminals in which the detecting device has detected start of a performance by the player has gone into the state of being able to participate in a session, and player identification information for the first session terminal, from the first session terminal, and the session support apparatus acquires a set of status transition information indicating that a player of a second one of the session terminals in which the detecting device has detected stoppage of a performance by the player over a predetermined time period has gone into a state of being unable to participate in a session, and player identification information for the second session terminal, from the second session terminal;

a status transition information transmitting module in which the session support apparatus transmits the acquired set of status transition information and player identification information to the session terminals; and a status information updating module in which each of the session terminals updates contents displayed on the display device thereof, based upon the status transition information and player identification information transmitted from the session support apparatus.

* * * * *